US012232675B2

(12) United States Patent
Rivette

(10) Patent No.: US 12,232,675 B2
(45) Date of Patent: Feb. 25, 2025

(54) VARIABLE ANGLE DUSTPAN

(71) Applicant: Marc Rivette, Long Sault (CA)

(72) Inventor: Marc Rivette, Long Sault (CA)

( * ) Notice: Subject to any disclaimer, the term of this patent is extended or adjusted under 35 U.S.C. 154(b) by 265 days.

(21) Appl. No.: 17/851,802

(22) Filed: Jun. 28, 2022

(65) Prior Publication Data

US 2023/0008151 A1 Jan. 12, 2023

(51) Int. Cl.
*A47L 13/52* (2006.01)
*A47L 13/51* (2006.01)

(52) U.S. Cl.
CPC ..... *A47L 13/52* (2013.01); *A47L 13/51* (2013.01)

(58) Field of Classification Search
CPC ..... A47L 13/51
USPC ..... 15/257.5–257.8
See application file for complete search history.

(56) References Cited

U.S. PATENT DOCUMENTS 469,781 A * 3/1892 Foose ..... A47L 13/52 15/257.8
497,401 A * 5/1893 Bates ..... A47L 13/52 15/257.7
1,669,302 A * 5/1928 Lanman ..... A47L 13/52 15/47
3,018,502 A * 1/1962 Lossius ..... A47L 13/52 15/257.7
3,603,628 A 9/1971 Smith
3,971,095 A 7/1976 Fish, Sr.
4,247,216 A 1/1981 Pansini
4,584,735 A 4/1986 Garber
4,907,710 A 3/1990 Bulkens
5,222,536 A 6/1993 Hodgdon et al.
5,412,835 A * 5/1995 Vosbikian ..... A47L 13/52 15/257.7
5,425,153 A * 6/1995 Vosbikian ..... A47L 13/52 15/257.7
5,511,807 A 4/1996 Snyder
5,548,864 A 8/1996 Vosbikian et al.
6,282,745 B1 * 9/2001 Alt ..... A47L 13/52 15/257.7
6,412,841 B1 * 7/2002 Loraas ..... A01B 1/00 294/51
6,732,402 B1 * 5/2004 Hsu ..... A47L 13/52 D32/74

(Continued)

*Primary Examiner* — Michael D Jennings
(74) *Attorney, Agent, or Firm* — Ostrager Chong Flaherty & Broitman P.C.

(57) ABSTRACT

A dustpan with handle combination is described which includes a slider plate apposed to a front surface of the handle. Slits through which stoppers are connected to the handle are provided to limit the range of movement of the slider plate. When the slider plate is extended downwards to a first position in use, the slider plate and handle lock against the back plate, below the rectangular block, at an obtuse angle for sweeping dirt. When the slider plate is retracted upwards to a second position, the dustpan rotates downwards with respect to the handle to a reflex angle ergonomically preferable for emptying dirt. When the slider plate is retracted upwards with the dustpan resting on a surface and the handle rotated forwards around the connecting means, the handle locks against the back plate at a convenient resting angle. When the slider plate is retracted upwards during non-use, the dustpan will rotate to align with the handle when laid flat or hung for space-saving during storage.

15 Claims, 11 Drawing Sheets

(56) References Cited

U.S. PATENT DOCUMENTS

| | | | | |
|---|---|---|---|---|
| 6,854,155 | B2 * | 2/2005 | Herndon | A47L 13/52 15/257.7 |
| 6,915,921 | B2 | 7/2005 | Mensch | |
| 6,974,167 | B2 | 12/2005 | Springs, II | |
| 8,904,589 | B2 | 12/2014 | Santarsiero et al. | |
| 9,027,197 | B1 | 5/2015 | Gao | |
| 9,611,095 | B2 | 4/2017 | Huff | |
| 9,839,280 | B2 | 12/2017 | Wingfield | |
| 9,913,566 | B1 | 3/2018 | McCormick | |
| 10,016,054 | B1 | 7/2018 | Parasher | |
| 10,201,262 | B1 * | 2/2019 | Serfas | A47L 13/51 |
| 10,626,568 | B2 * | 4/2020 | McCormick | E01H 1/1206 |
| 2002/0104551 | A1 * | 8/2002 | Mead | A47L 13/52 15/257.3 |
| 2003/0088938 | A1 * | 5/2003 | Herndon | A47L 13/52 15/257.7 |
| 2006/0059651 | A1 * | 3/2006 | Edwards | A47L 13/52 15/257.7 |
| 2007/0163069 | A1 * | 7/2007 | Sampaio | A47L 13/52 15/257.7 |
| 2016/0128462 | A1 * | 5/2016 | Hoff | A47L 13/52 15/105 |
| 2019/0150698 | A1 * | 5/2019 | Gregory | A47L 13/52 |
| 2021/0177232 | A1 * | 6/2021 | Saluccio | A47L 13/52 |

* cited by examiner

VARIABLE ANGLE DUSTPAN

FIELD OF THE INVENTION

This invention relates to a dustpan with handle that can be variably angled to suit dust collection, dustpan emptying and dustpan storage.

BACKGROUND OF THE INVENTION

Various models of dustpan have long handles to avoid back strain and to avoid exposure to dirt while sweeping but it can be difficult to maintain an angle between the dustpan and handle that is ergonomically desirable for sweeping. Long handled models of dustpans can also be difficult to empty. They can be turned over to empty while holding the end of the handle which is an awkward movement that may cause upper body and back strain. Alternatively, it is necessary to bend down and hold the pan which is also awkward and exposes the operator to the dust and dirt in the full pan such that allergenic particles, infectious particles or other toxic particles may be inhaled and infectious or toxic material may come into contact with the skin.

It would be advantageous to have a long-handled dustpan with a simple system to establish an ergonomically preferable angle between the dustpan and handle for sweeping.

It would be further advantageous to have a long-handled dustpan with a simple system that could permit emptying without turning the pan over by the end of the handle or bending down and holding the pan, thereby avoiding upper body and back strain and exposure to the contents of the full dustpan.

It would be still further advantageous if the dustpan was easy to store and occupied minimal space during storage.

It would be still further advantageous if the dustpan could be easily removed from the handle and replaced with another dustpan.

SUMMARY OF THE INVENTION

According to one embodiment of the invention, there is provided a dustpan with handle combination comprising a dustpan having a bottom, sides and a back plate, two hinge plates apposed to the centre of the back plate separated by a block, a handle movably connected between the two hinge plates by connecting means; a slider plate apposed to a front surface of the handle, including means to limit the range of movement of the slider plate. A strut extends posteriorly between the two hinge plates.

Slits through which stoppers are connected to the handle are provided to limit the range of movement of the slider plate. When the slider plate is extended downwards to a first position in use, the slider plate and handle lock against the back plate, below the rectangular block, at an obtuse angle for sweeping dirt. When the slider plate is retracted upwards to a second position, the dustpan rotates downwards with respect to the handle to a reflex angle ergonomically preferable for emptying dirt. When the slider plate is retracted upwards with the dustpan resting on a surface and the handle rotated forwards around the connecting means, the handle locks against the back plate at a convenient resting angle. When the slider plate is retracted upwards during non-use, the dustpan will rotate to align with the handle when laid flat or hung for space-saving during storage.

A top section of the handle is adapted to incorporate a hanging means.

BRIEF DESCRIPTION OF THE DRAWINGS

Embodiments of the invention will now be described by reference to the following drawings in which.

DETAILED DESCRIPTION

Structure (a) Overview

Figure 1:
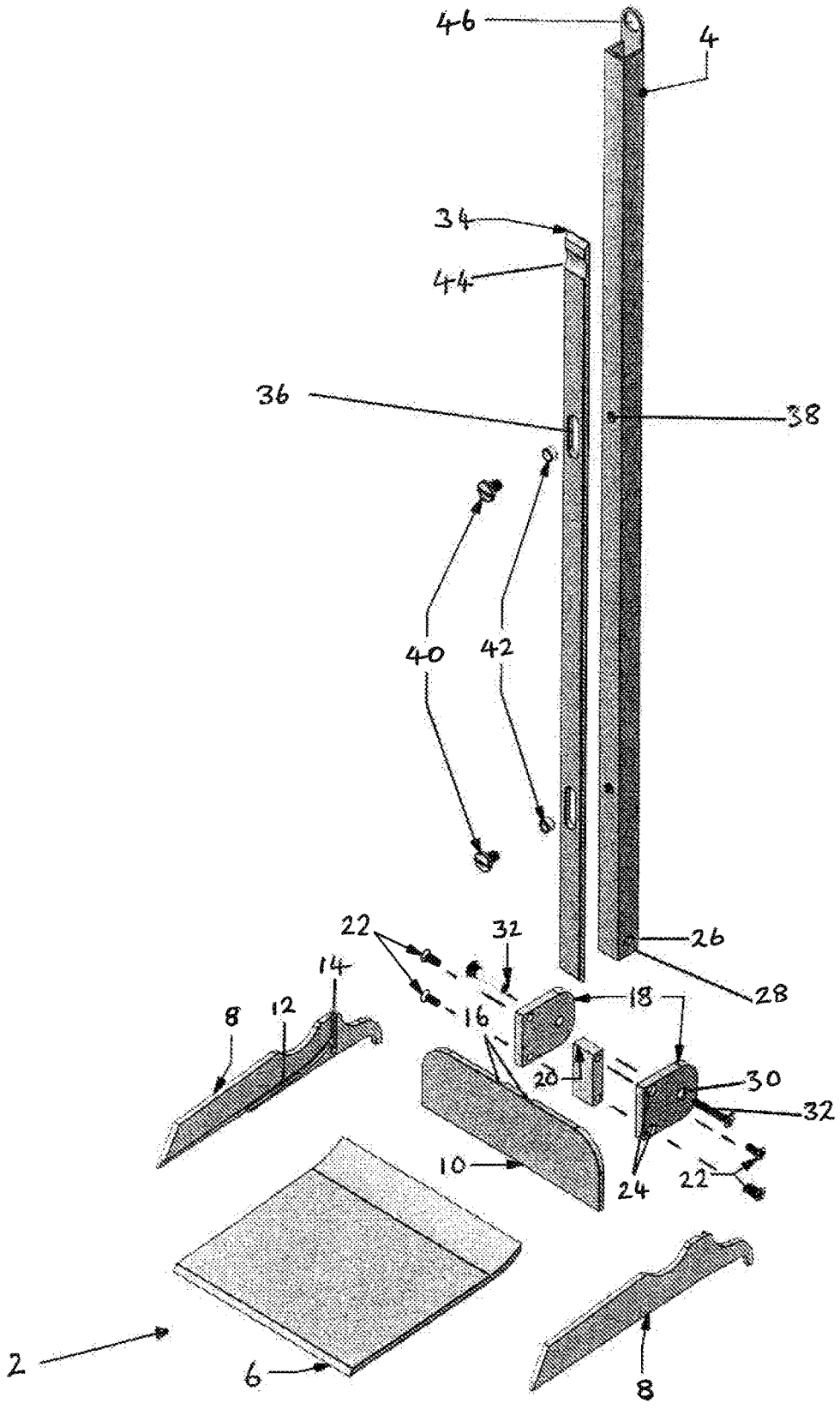
FIG. 1 is an exploded perspective view of the dustpan with handle.

As shown in FIG. 1, there is provided an exploded view of a dustpan 2 with handle 4. The dustpan 2 includes a base 6, two side pieces 8, and a back plate 10. Each side piece 8 includes a first groove 12 for receiving one edge of the base 6, and a second groove 14 for receiving the back plate 10. The back plate 10 has two grooves 16 which receive one edge of each of a pair of hinge plates 18. A pair of screws 22 pass through two holes 24 located at the front of the hinge plates 18 and through a rectangular block 20. Adhesive is used where required. Alternatively, the dustpan 2 could be a unitary piece made of any suitable material such as plastic.

The handle 4 has a hole 26 at its lower end 28 which aligns with a corresponding hole 30 found at the rear of each of the hinge plates 18, through which a pin 32 passes to enable the handle 4 to swivel freely with respect to the dustpan 2.

Figure 10:
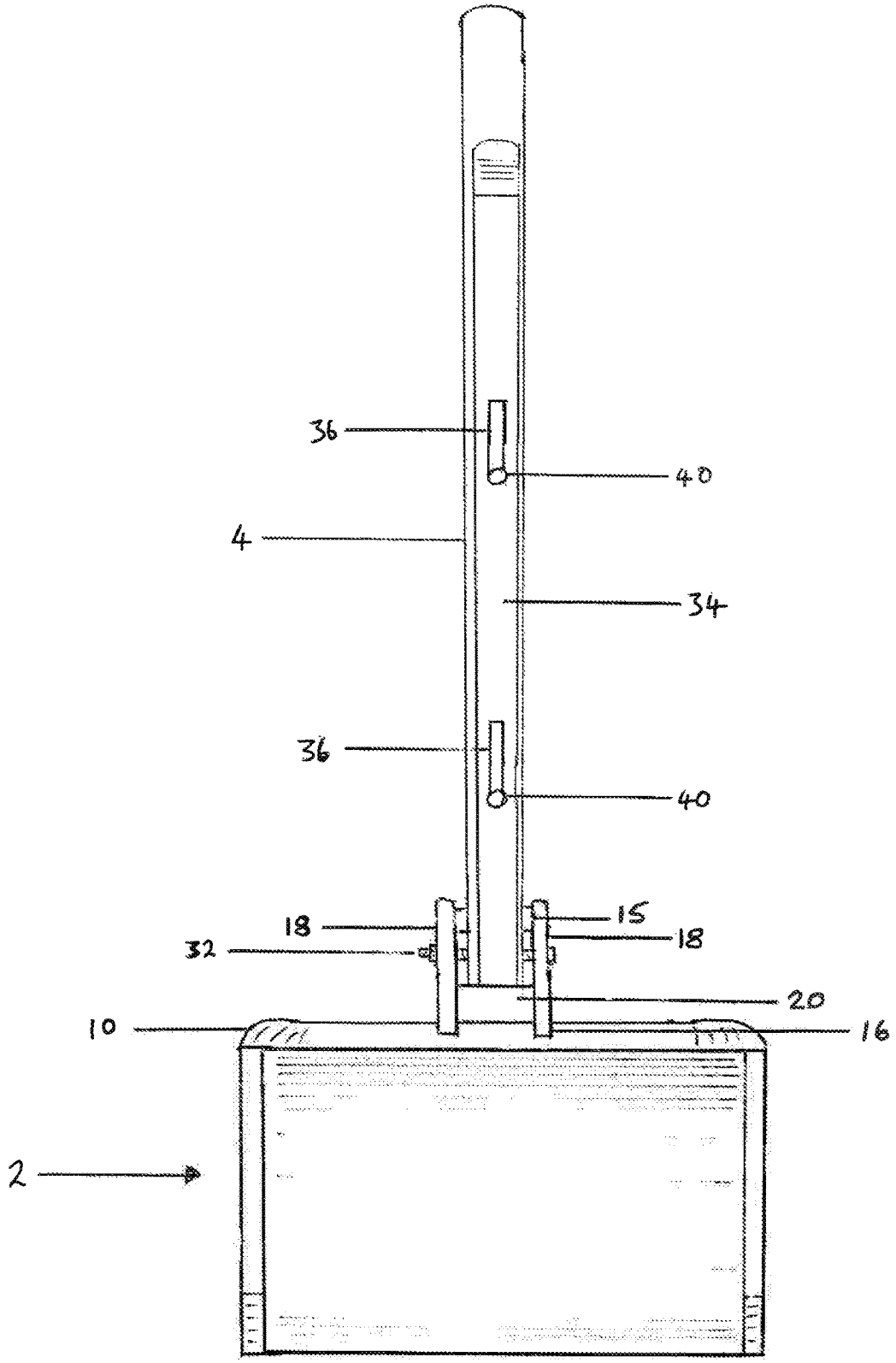
FIG. 10 is a front view of the dustpan with handle of FIG. 8.

A slider plate 34 rests on the front side of the handle 4. Two slits 36 are positioned in line with two holes 38 in the handle 4. The slits 36 may be in the form of an oval channel as shown in FIG. 1 or a rectangular channel as shown in FIG. 10. Screws 40 are inserted through slider bushings 42 and into the two holes 38 in the handle 4 to maintain the slider plate 34 in relation to the handle 4 such that the slider plate 34 can move from an upper position where the dustpan 2 can move relative to the handle 4, to a lower position, where the slider plate 34 engages with the rectangular block 20 to prevent the dustpan 2 from moving freely relative to the handle 4.

The slider plate 34 may optionally include a thumb groove or notch 44 to ease the movement of the slider plate 34 by the user.

The handle 4 may optionally include hanging means 46 to hang the handle 4.

(b) First position for Dust Collection

Figure 2:
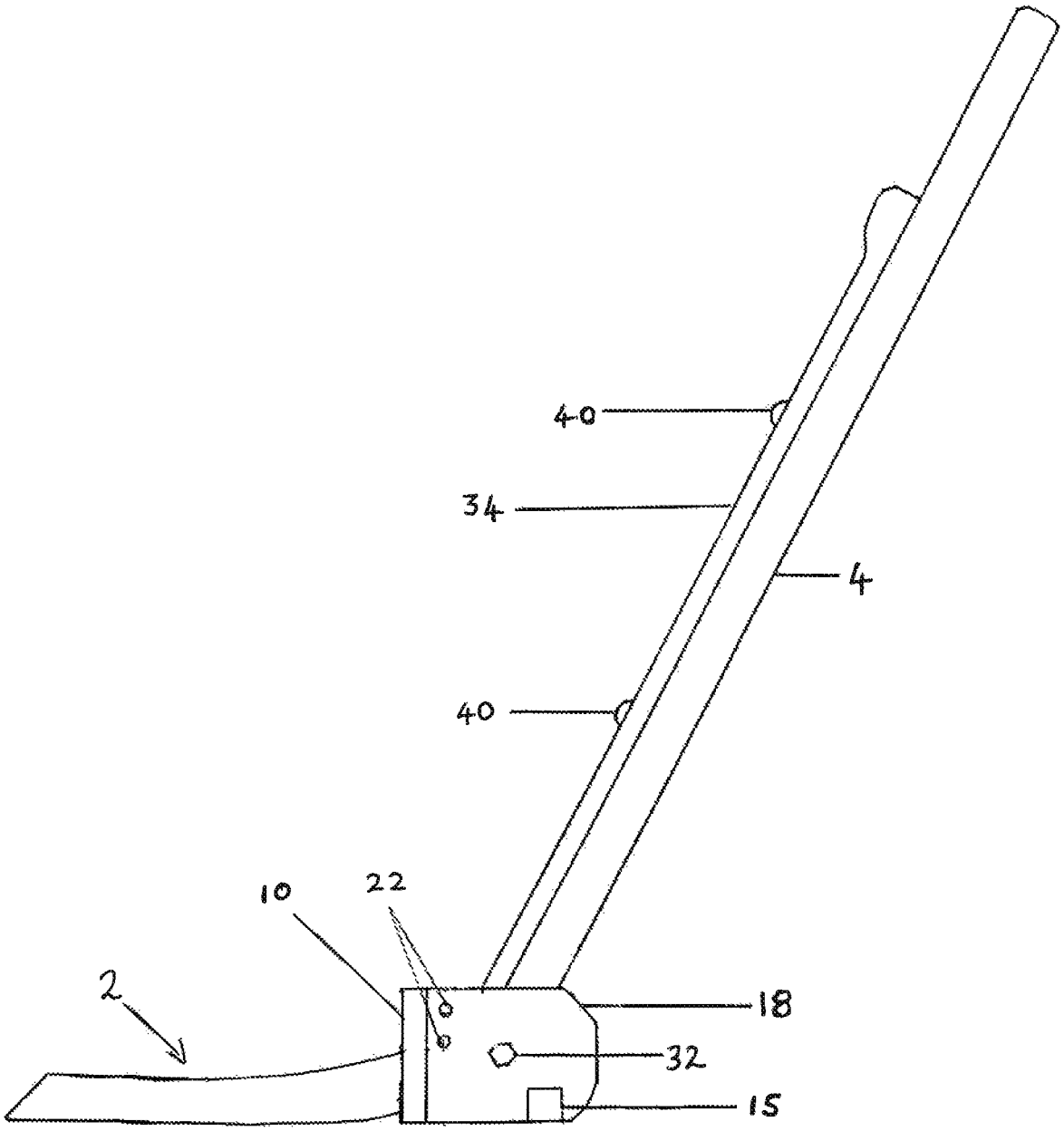
FIG. 2 is a right-side view of a dustpan with handle at a preferred angle for dust collection.

As shown in FIG. 2, the dustpan 2 with handle 4 is shown at an angle that is ergonomically preferable for dust collection. The lower end of the handle 4 is attached between the two hinge plates 18 by connecting means 32, such as a bolt or pin, in a manner that permits rotation such that the angle between the dustpan 2 and the handle 4 can be altered. A strut 15 extends posteriorly between the two hinge plates 18 for added strength and to prevent the handle 4 from rotating backwards beyond an angle preferable for emptying the dustpan 2. The slider plate 34 is apposed to the front surface of the handle 4 by the use of screws 40 that extend through slits 36 (not shown) in the slider plate 34.

Figure 3:
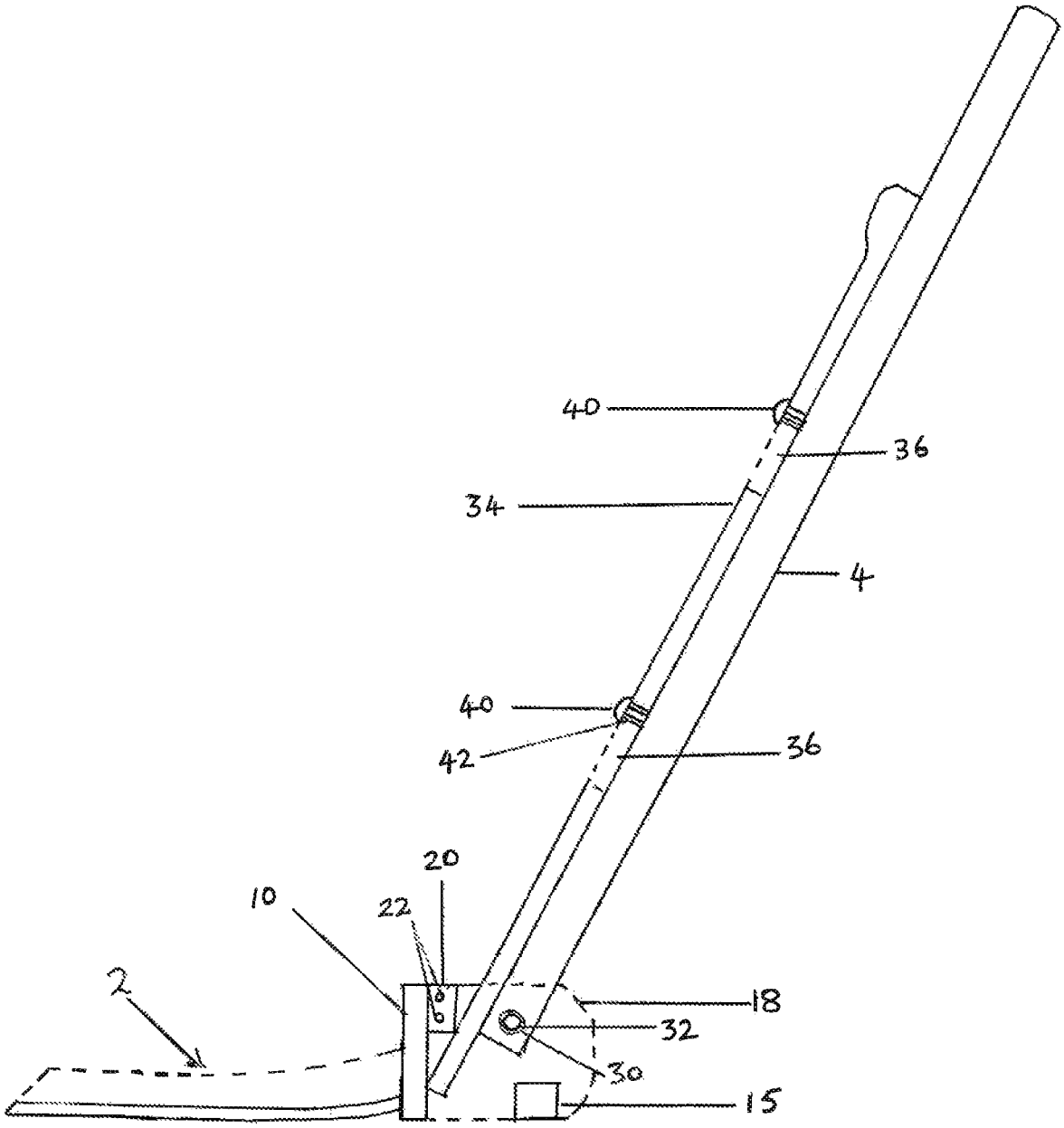
FIG. 3 is a right-side, cross-sectional view of the dustpan with handle of FIG. 2.

Referring to FIG. 3, a right-side cross-sectional view is shown through the vertical axis of the dustpan 2 with handle 4 of FIG. 2. The slider plate 34 is shown extended such that it locks behind the rectangular block 20 between the two hinge plates 18. The fixed position of the slider plate 34 behind the rectangular block 20 and against the back plate 10 of the dustpan 2 maintains the dustpan 2 with handle 4 at a preferred angle for dirt collection.

(b) Second Position for Emptying the Dustpan

Figure 4:
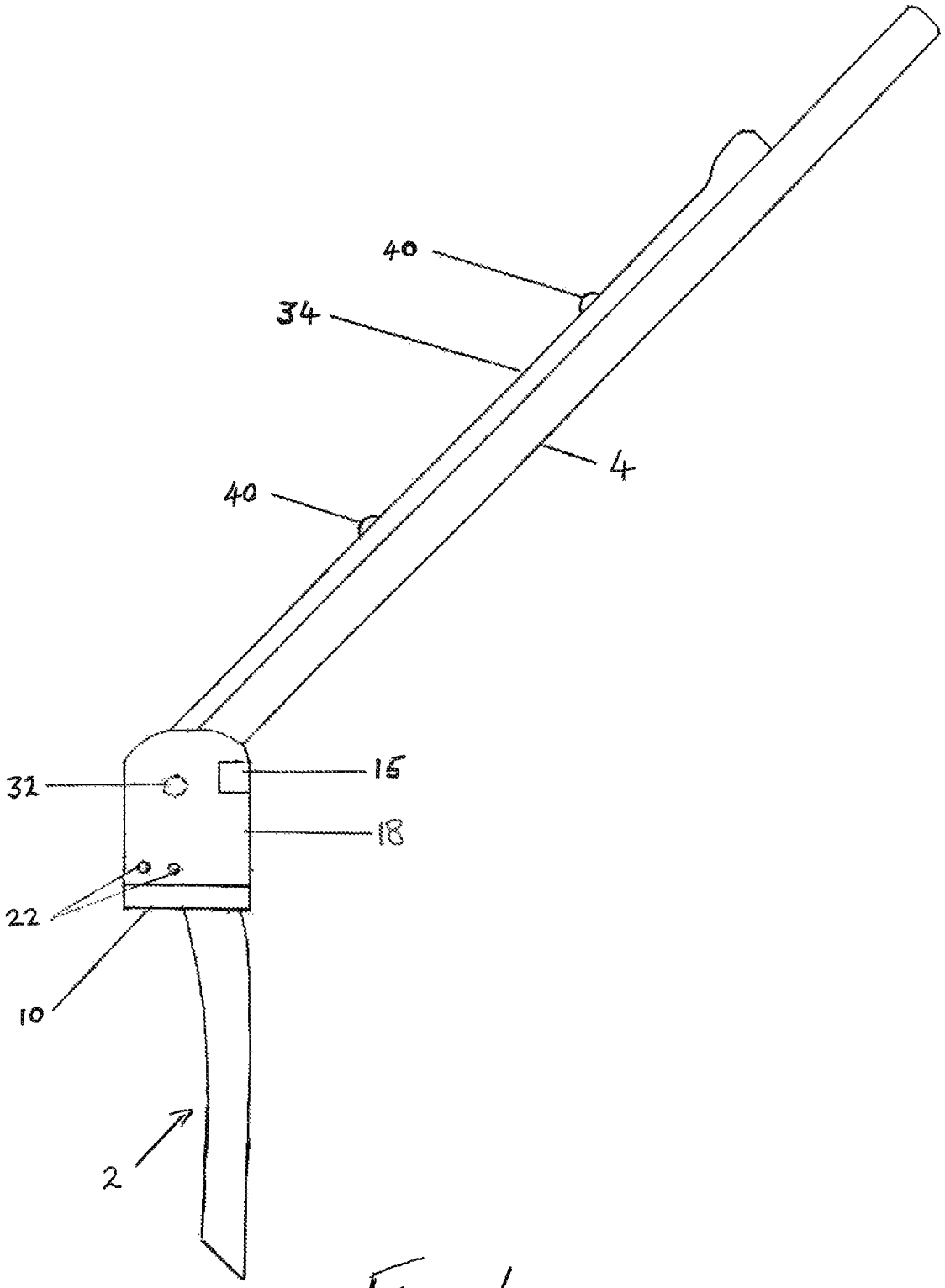
FIG. 4 is a right-side view of the dustpan with handle in a position for emptying the dustpan.

Referring to FIG. 4, the dustpan 2 with handle 4 is shown in a second position for emptying the dirt. When the slider plate 34 is in its upper position, the dustpan 2 swings downwards relative to the handle 4, to the limit permitted by the strut 15, and the dustpan 2 can be emptied at a convenient angle.

Figure 5:
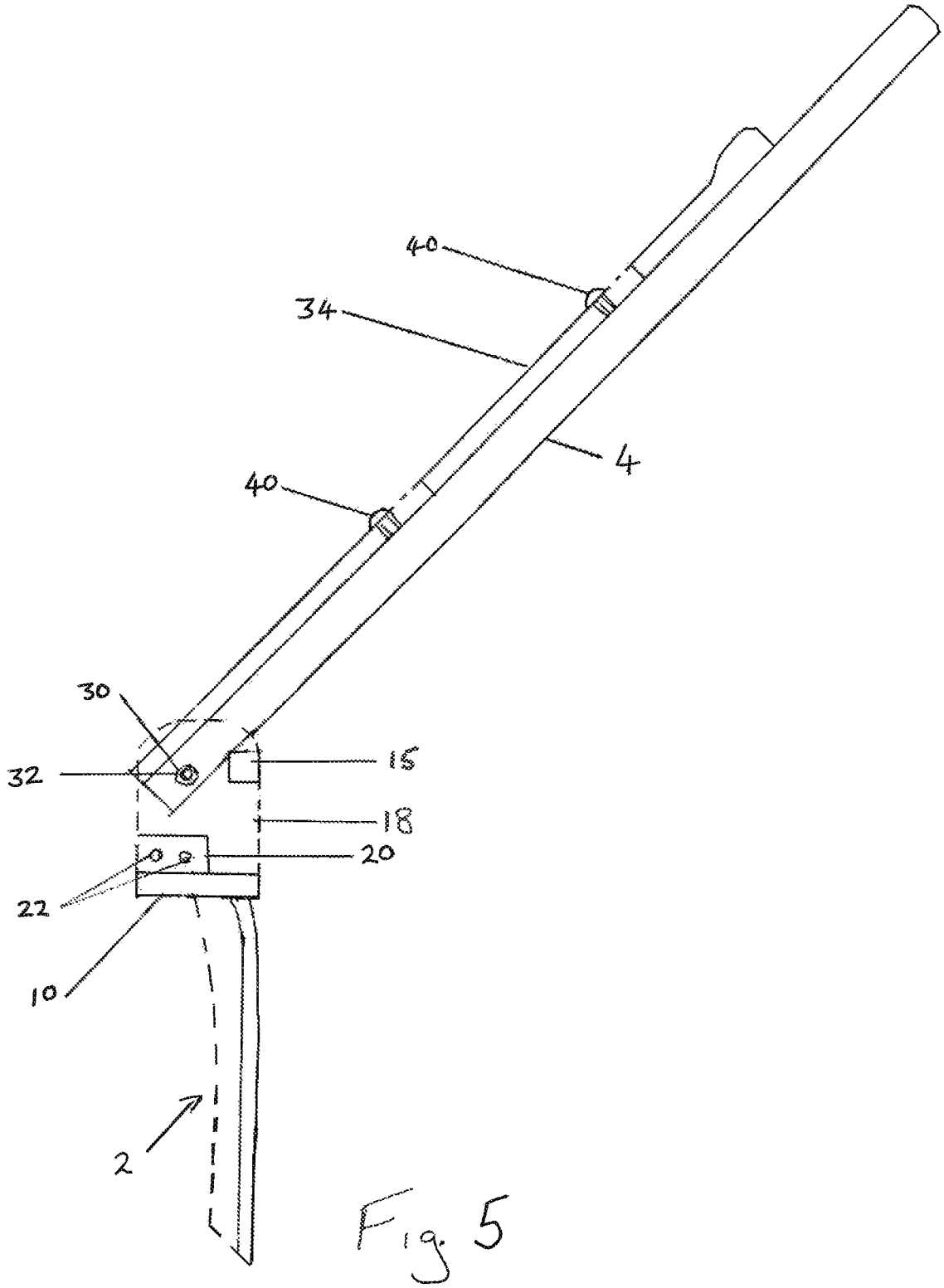
FIG. 5 is a right-side, cross-sectional view of the dustpan with handle of FIG. 4.

FIG. 5 is a right-side cross-sectional view of the dustpan 2 with handle 4 shown through the vertical axis of the dustpan 2 with handle 4 shown in the position of FIG. 3 for emptying the dirt.

(c) Third Position fog Dustpan Standing

Figure 6:
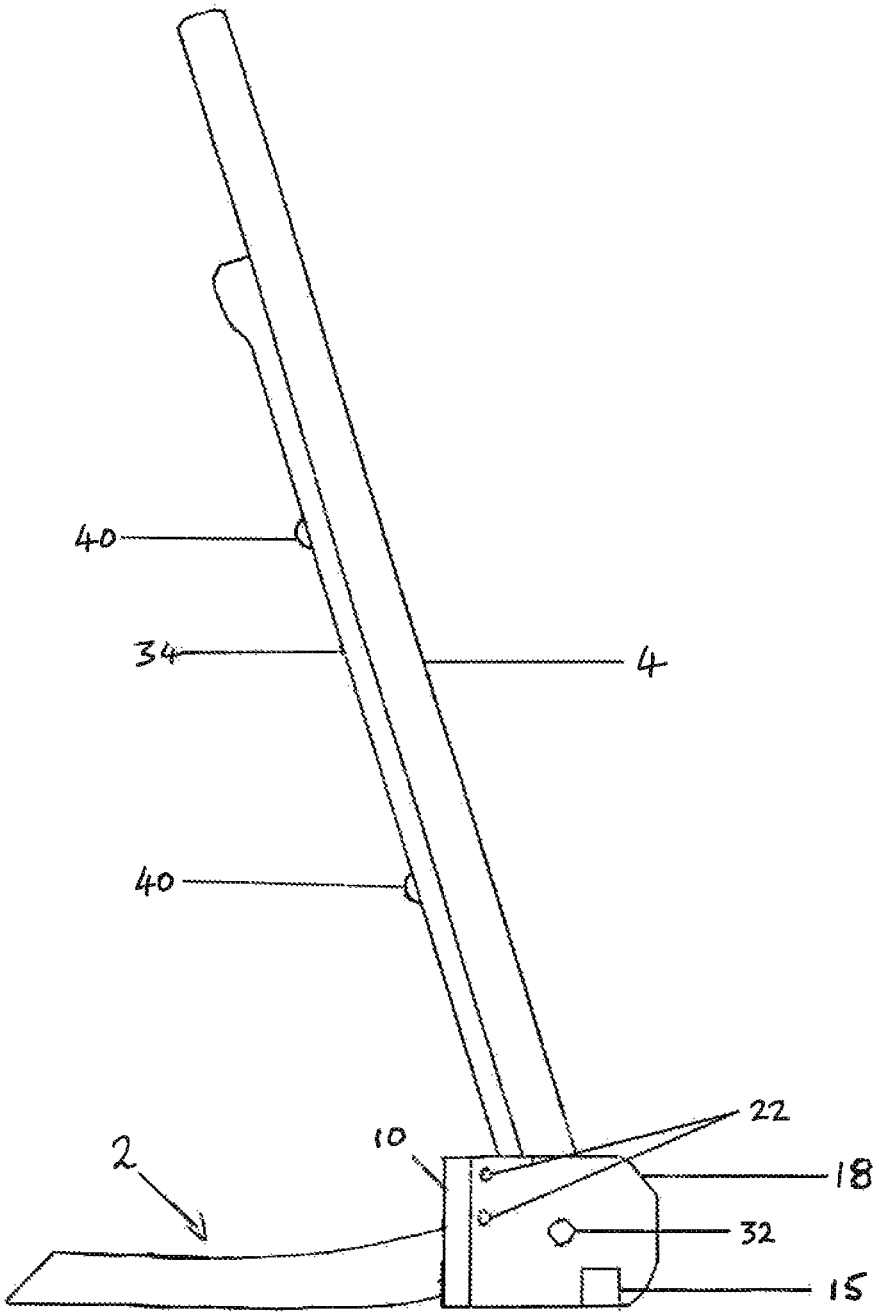
FIG. 6 is a right-side view of the dustpan with handle at a resting angle.
Figure 7:
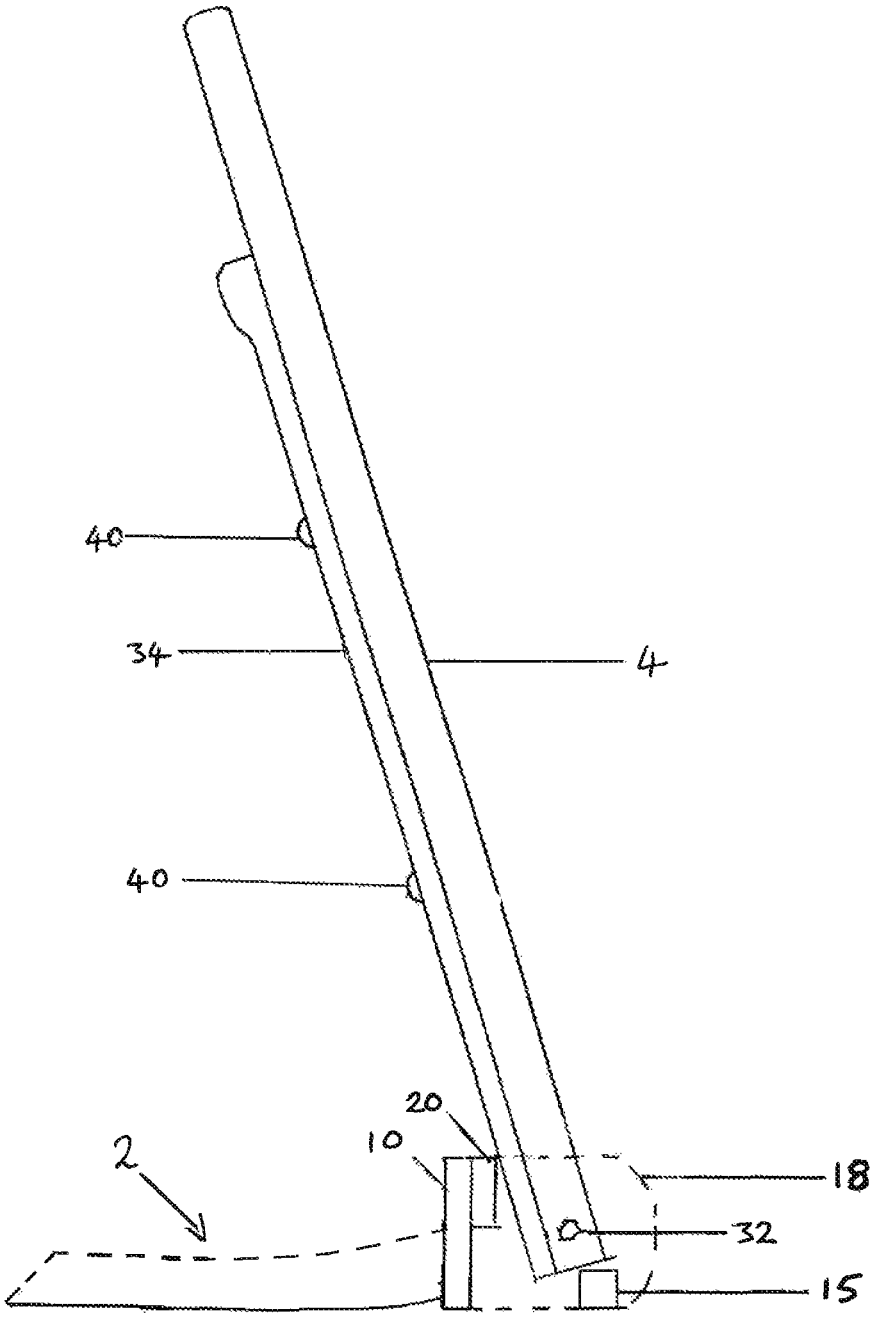
FIG. 7 is a right-side, cross-sectional view of the dustpan with handle of FIG. 6.

Referring to FIG. 6, the dustpan 2 with handle 4 is shown in a third position for hands-free standing. The dustpan 2 with handle 4 is placed on the floor with the slider plate 34 in its upper position and the handle 4 leant forward. The dustpan 2 with handle 4 will lock in a convenient resting position. This position is shown in cross-section in FIG. 7.

(d) Fourth Position for Dustpan Storage

Figure 8:
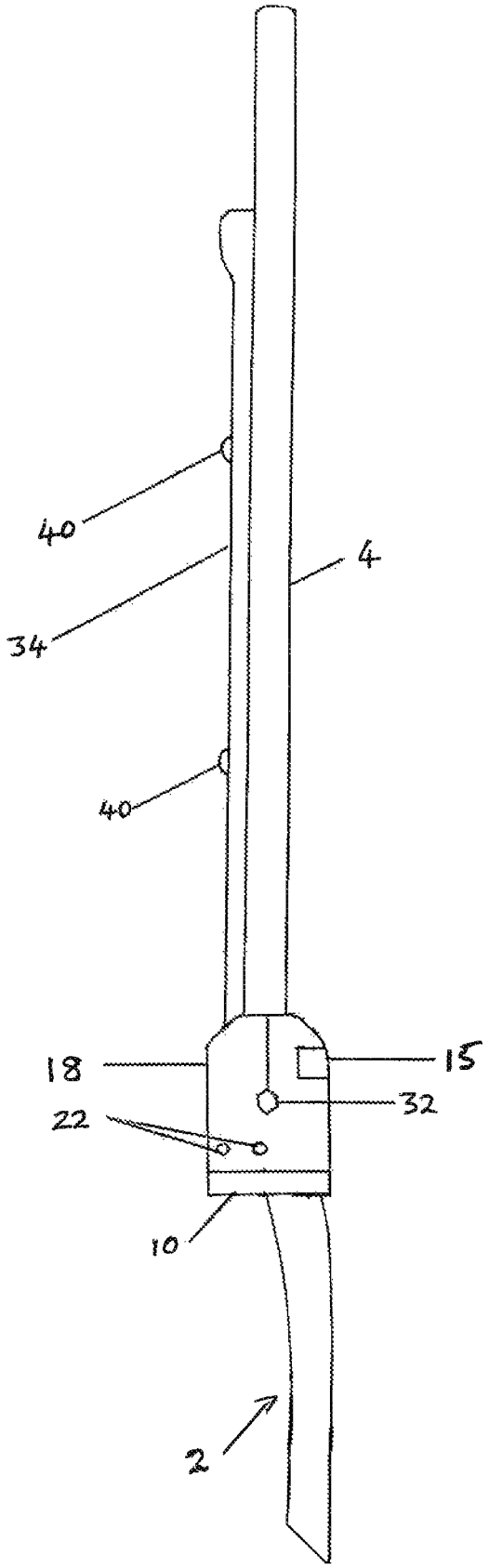
FIG. 8 is a right-side view of the dustpan with handle in a hanging storage position.
Figure 9:
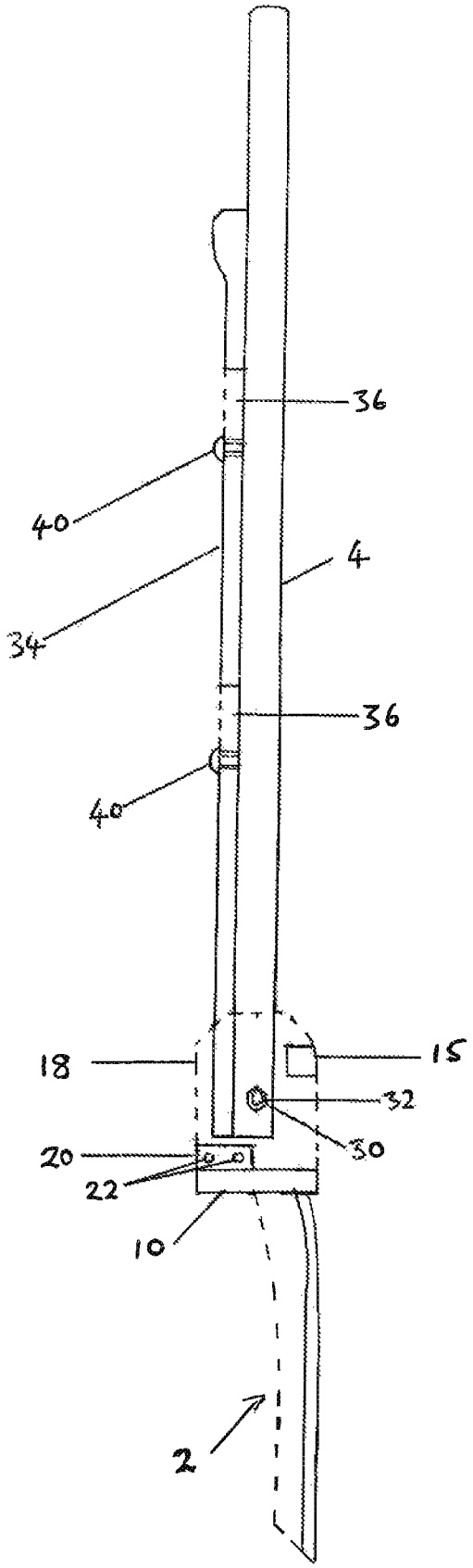
FIG. 9 is a right-side, cross-sectional view of the dustpan with handle of FIG. 8.

Referring to FIG. 8, the dustpan 2 with handle 4 is shown in a fourth position for hanging the dustpan 2 and handle 4 for storage. The slider plate 34 is in its upper position and the dustpan 2 swung downwards to align with the plane of the handle 4. This position is shown in cross-section in FIG. 9. A means for hanging the dustpan 2 with handle 4, such as a hole for a hook or rod, can be incorporated into the top end of the handle 4.

Figure 11:
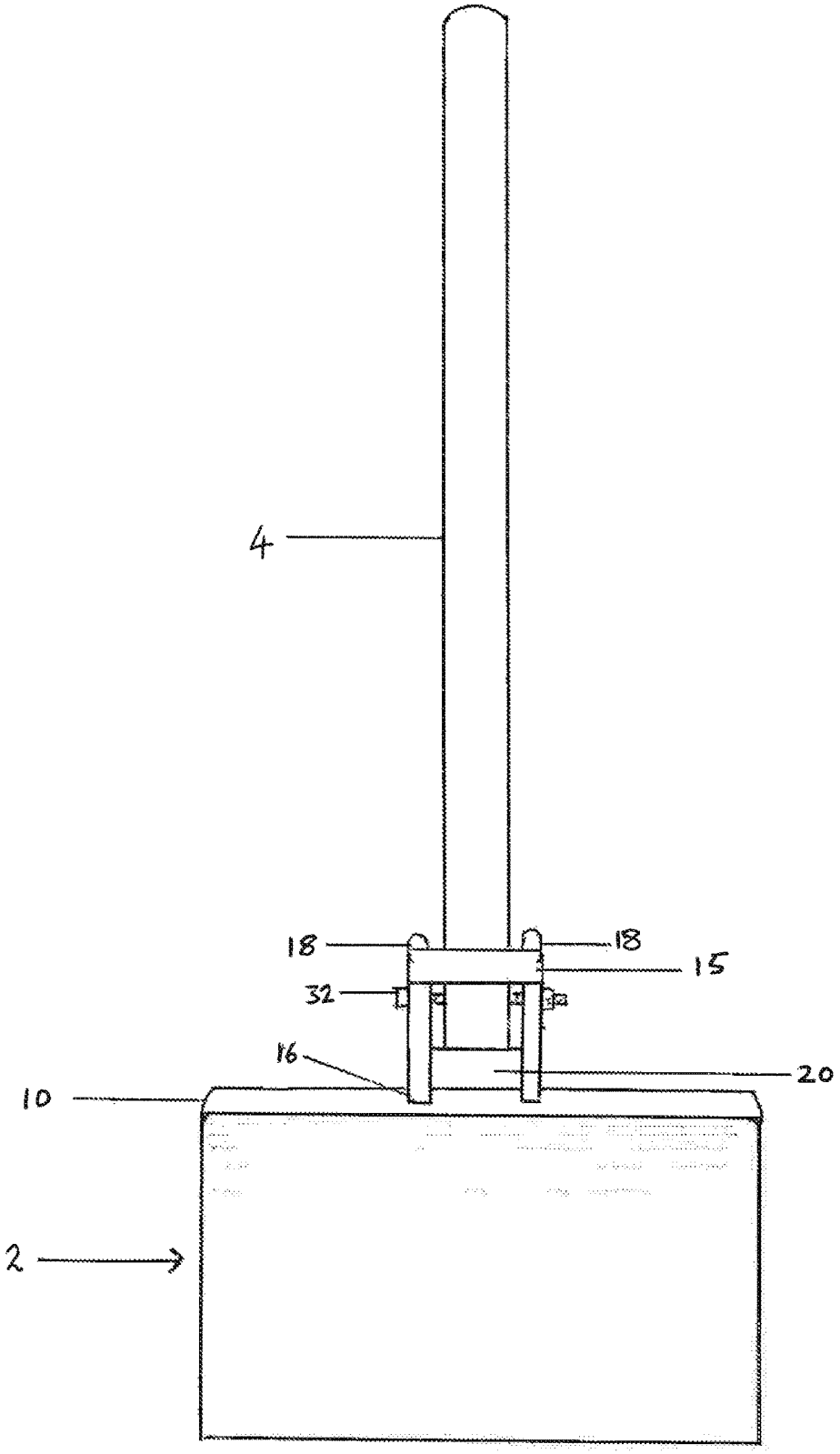
FIG. 11 is a back view of the dustpan with handle of FIG. 8.

FIG. 10 shows a front view of the dustpan 2 with handle 4 in the hanging position for storage. The two hinge plates 18 are shown recessed into the two grooves 16 in the back plate 10 of the dustpan 2. The corresponding back view is shown in FIG. 11.

Use (a) Dust Collection

As shown in FIG. 2, during sweeping, the user extends the slider plate 34 so that it locks behind the rectangular block 20 between the two hinge plates 18 and against the back plate 10. This maintains the dustpan 2 with handle 4 at a preferred angle for dirt collection. A conventional broom (not shown) is used in the normal manner to sweep dirt into the dustpan 2.

(b) Emptying the Dustpan

Once the sweeping operation is complete, the use moves the slider plate 34 to its upper position so that the dustpan 2 can swings down to an ergonomically preferable angle, limited by the strut 15, to empty the dirt into an appropriate receptacle such as a garbage bin (not shown).

(c) Dustpan Standing

When the dustpan 2 is not in use, it can be placed on the floor in a free-standing position. The slider plate 34 is moved to its upper position. When the handle 4 is leant forward, the dustpan 2 will lock in a resting position.

(d) Dustpan Storage

The ability to hang the dustpan 2 in line with the handle 4 permits storage with minimal use of space. A number of the items could be hung in front of each other on a rod, for example or stacked flat.

(a) Dustpan Replacement

The simplicity of the connecting means 32 between the handle 4 and the dustpan 2 allows for simple removal and replacement of the dustpan 2 so that a more specialized dustpan 2 can be used in industry situations.

The scope of the claims should not be limited by the preferred embodiments set forth in the examples, but should be given the broadest interpretation consistent with the description as a whole.

LIST OF REFERENCE NUMBERS

2 dustpan
4 handle
6 base
8 side piece
10 back plate
12 first groove
14 second groove
15 strut
16 two grooves
18 hinge plates
20 rectangular block
22 screws
24 holes
26 hole
28 lower end
30 hole
32 pin
34 slider plate
36 slits
38 holes
40 screws
42 slider bushings
44 thumb groove or notch
46 hanging means

The invention claimed is:

1. A dustpan with handle combination comprising:
the dustpan having a bottom, sides and a back plate;
two hinge plates apposed to the centre of the back plate separated by a block;
the handle movably connected between the two hinge plates by connecting means;
a slider plate movably connected to a front surface of the handle; and limiting means for limiting the range of movement of the slider plate.

2. The dustpan with handle combination according to claim 1 further including a strut extending posteriorly between the two hinge plates.

3. The dustpan with handle combination according to claim 2 whereby:

when the slider plate is retracted upwards to a second position, the dustpan rotates downwards to a reflex angle with the handle ergonomically preferable for emptying dirt.

4. The dustpan with handle combination according to claim 1 wherein:

the means to limit the range of movement of the slider plate are slits through which stoppers are connected to the handle.

5. The dustpan with handle combination according to claim 1 wherein:

when the slider plate is extended downwards to a first position in use, the slider plate and the handle lock against the back plate of the dustpan, below the block, at an obtuse angle for sweeping dirt.

6. The dustpan with handle combination according to claim 1 whereby:

when the slider plate is retracted upwards with the dustpan resting on a surface and the handle rotated forwards around the connecting means, the handle locks against the back plate at a convenient resting angle.

7. The dustpan with handle combination according to claim 1 whereby:

when the slider plate is retracted upwards during non-use, the dustpan will rotate to align with the handle when laid flat or hung for space-saving during storage.

8. The dustpan with handle combination according to claim 1 wherein a top section of the handle is adapted to incorporate a hanging means.

9. An apparatus for collecting dust comprising:

a dustpan having a bottom, sides and a back plate;

two hinge plates connected to the back plate, the two hinge plates each having a front edge positioned against the back plate in a vertical direction and a distal rear edge;

a block connected to the back plate, the block having a top surface aligned with a top edge of the back plate and a bottom surface that extends partially down the back plate;

a handle having a bottom portion pivotally connected between the two hinge plates about a horizontal axis through the two hinge plates positioned at a mid-point between the front edge and the distal rear edge of the two hinge plates;

an elongated slider plate movably connected to a front surface of the handle, the slider plate movable between a first position where a bottom edge of the slider plate is aligned with the bottom surface of the handle and a second position where the bottom edge of the slider plate extends beyond the bottom portion of the handle; and limiting means for limiting the range of movement of the slider plate between the first position and the second position.

10. The apparatus according to claim 9 wherein:

when the slider plate is moved to the second position and the handle is pivoted backward about the axis, the slider plate and the bottom portion of the handle lock against the back plate of the dustpan below the block at an obtuse angle relative to the bottom of the dustpan.

11. The apparatus according to claim 9 wherein:

the limiting means comprises slits in the slider plate through which stoppers are connected to the handle.

12. The apparatus according to claim 9 wherein:

when the slider plate is retracted to the first position, the block and the back plate of the dustpan do not engage the slider plate and the bottom of the handle and the dustpan is free to rotate about the axis relative to the handle to a reflex angle relative to the front surface of the handle, with the handle in an ergonomically preferable position for emptying dirt from the dust pan.

13. The apparatus according to claim 12, further comprising a strut extending posteriorly between the two hinge plates proximate a bottom edge of the hinge plates, the strut positioned to stop rotation of the handle in the reflex angle.

14. The apparatus according to claim 9 wherein:

when the slider plate is retracted to the first position and the bottom of the dustpan is resting on a surface, the handle is free to rotate about the axis in a forward direction toward the dustpan until the front surface of the handle locks against a top of the block at the top surface of the back plate at a convenient resting angle.

15. The apparatus according to claim 1 wherein:

when the slider plate is retracted to the first position and the handle is laid flat or hung during non-use, the dustpan is free to rotate to align the dustpan with the handle for space-saving during storage.

* * * * *